US006155219A

United States Patent [19]

Fukuhara et al.

[11] Patent Number: 6,155,219

[45] Date of Patent: Dec. 5, 2000

[54] VALVE TIMING ADJUSTING APPARATUS FOR INTERNAL COMBUSTION ENGINE

[75] Inventors: Katsuyuki Fukuhara, Hyogo; Mutsuo Sekiya, Tokyo, both of Japan

[73] Assignee: Mitsubishi Denki Kabushiki Kaisha, Tokyo, Japan

[21] Appl. No.: 09/393,363

[22] Filed: Sep. 10, 1999

[30] Foreign Application Priority Data

Sep. 10, 1998 [JP] Japan ..... 10-257149
Jul. 5, 1999 [JP] Japan ..... 11-190623

[51] Int. Cl.[7] ..... F01L 1/34

[52] U.S. Cl. ..... 123/90.17; 74/568 R; 464/61

[58] Field of Search ..... 123/90.17, 90.31, 123/90.15; 464/1, 2, 160, 161; 74/567, 568

[56] References Cited

U.S. PATENT DOCUMENTS 5,566,651 10/1996 Strauss et al. ..... 123/90.17
5,588,404 12/1996 Lichti et al. ..... 123/90.17
5,638,782 6/1997 Eguchi et al. ..... 123/90.17
5,870,983 2/1999 Sato et al. ..... 123/90.17

FOREIGN PATENT DOCUMENTS 04358710 12/1992 Japan .
09264110 10/1997 Japan .
9-264110 10/1997 Japan .
2080923 2/1982 United Kingdom .
2228780 5/1990 United Kingdom .

*Primary Examiner*—Thomas Denion
*Assistant Examiner*—Patrick Cavaliere
*Attorney, Agent, or Firm*—Sughrue, Mion, Zinn, Macpeak & Seas, PLLC

[57] ABSTRACT

The valve timing adjusting apparatus comprises a bias means that generates an urging force between the casing and the rotor, and the thus generated urging force is set to the level equal to or below the average inertia torque of the camshaft within the time period until the spark ignition is generated after one rotation of the crank shaft at the starting time of the combustion engine, so that by the varied torque at the time of starting of the combustion engine and the urging force, the rotor can be rapidly shifted toward the advance side or retard side with a relatively small force, improving thereby the response characteristic of the valve opening/closing system.

9 Claims, 8 Drawing Sheets

VALVE TIMING ADJUSTING APPARATUS FOR INTERNAL COMBUSTION ENGINE

BACKGROUND OF THE INVENTION

1. Field of the Invention

The present invention relates to a valve timing adjusting apparatus, which variably controls the timing for opening and/or closing at least one of an intake valve and an exhaust valve in accordance with the driving state of the internal combustion engine.

2. Description of the Related Art

As a conventional valve timing adjusting apparatus for internal combustion engine, there has been disclosed a device that comprises a casing integrally provided with a timing sprocket or a timing pulley, to which a rotational force is transmitted from a crank shaft of the internal combustion engine (hereinafter may be referred to just as a "combustion engine"), a rotor which is connected to a camshaft residing in the control system side for controlling the timing for opening and/or closing the intake valve and/or the exhaust valve of the combustion engine and is accommodated in the casing, and a bias means for urging an unidirectional rotational force to the rotor, wherein the timing for opening and/or closing the intake valve and/or the exhaust valve is adjusted by controlling the oil pressure in the hydraulic chambers formed between a plurality of shoes of the casing and vanes of the rotor, and changing thereby the relative rotational phase difference between the casing and the rotor.

In the configuration above, the bias means urges the rotor with an urging force which is set to the level equal to or greater than the maximum inertia torque or the average inertia torque of the camshaft at the time of starting of the combustion engine, and the rotor is maintained at the most advanced position by this urging force when the combustion engine comes to a halt. In this way, due to the fact that the rotor is maintained at the most advanced position when the combustion engine has come to an inactive state, the valve open period of the intake valve and that of the exhaust valve will never exist simultaneously, so that the combustion gas is prevented from returning, and the combustion engine can thus be driven properly.

As the reference documents disclosing the conventional valve timing adjusting apparatus for internal combustion engine, there are a document titled "Kokai Giho" by "Hatsumei Kyokai" with the volume number 87-8631, Japanese Patent Application Laid-Open No. 10-68306, Japanese Patent Application Laid-Open No. 9-264110 and so on. In these documents, the former document "Kokai Giho" discloses such technique that an urging force is supplied in a specific predetermined direction by providing a spring between the rotor and the casing, whereas the latter patent application documents disclose a device, which is provided with a most advanced position holding (or locking) mechanism, and supplies an urging force in the advance direction, wherein the thus supplied urging force is set to the level equal to or greater than the maximum torque or the average torque at the starting time of the combustion engine.

As the conventional valve timing adjusting apparatus for internal combustion engine is configured as explained above, an urging force of the bias means urging the rotor is set to the level greater than the maximum inertia torque or the average inertia torque at the starting time of the combustion engine, and the rotor is urged toward the advance side with respect to the casing by the urging force, so that in a case that the relative phase difference between the casing and the rotor is varied toward the direction opposite to the direction of the urging force by the oil pressure supplied to the hydraulic chambers formed between shoes of the casing and vanes of the rotor, the response characteristic with respect to the relative rotations of the casing and the rotor is deteriorated due to the effect of the urging force, and thus the operation speed is also lowered.

SUMMARY OF THE INVENTION

The present invention has been proposed to solve the problems aforementioned, and it is an object of the present invention to provide a valve timing adjusting apparatus for internal combustion engine which is capable of improving the response characteristic of the rotor at the starting time of the internal combustion engine.

It is also another object of the present invention to provide a valve timing adjusting apparatus for internal combustion engine which is capable of shifting the camshaft of the exhaust valve system toward the advance side by an urging force of the rotor and the varied torque of the camshaft at the starting time of the internal combustion engine even when the combustion engine has come to a halt, and making the advanced position holding mechanism operate at the most advanced position.

It is further object of the present invention to provide a valve timing adjusting apparatus for internal combustion engine which is capable of shifting the camshaft of the intake valve system toward the retard side by an urging force of the rotor and the varied torque of the camshaft at the time of starting of the internal combustion engine even when the combustion engine has come to a halt, and making the retarded position holding mechanism operate at the most retarded position.

It is still further object of the present invention to provide a valve timing adjusting apparatus for internal combustion engine which is capable of adopting any spring having a returning force as a bias means.

It is still further object of the present invention to provide a valve timing adjusting apparatus for internal combustion engine which is capable of sharing the conventionally used members for most of the essential configuring members, and thereby raising the productivity thereof.

In order to achieve the above object, the valve timing adjusting apparatus for internal combustion engine according to the first aspect of the present invention is constructed in such a manner that it comprises: a camshaft for opening and closing at least one of an intake valve and an exhaust valve in an internal combustion engine, a casing which is rotatably mounted around the camshaft, and rotates in accordance with the movement of a crank shaft of the internal combustion engine, a rotor which is connected to the camshaft and accommodated in the casing, and is capable of rotating coaxially with and relatively to the casing, and a bias means for generating an urging force between the rotor and the casing, wherein the valve timing adjusting apparatus is arranged in such a manner that the urging force is set to the level equal to or below the average inertia torque of the camshaft within the period until the spark ignition occurs after one rotation of the crank shaft at the starting time of the combustion engine.

The valve timing adjusting apparatus for internal combustion engine according to the second aspect of the present invention is constructed such that the bias means urges the camshaft of an exhaust-valve system for opening and closing the exhaust valve toward the advance side, and the urging force is set to the level equal to or below the average inertia torque of the camshaft within the period until the spark ignition occurs after one rotation of the crank shaft at the starting time of the combustion engine.

The valve timing adjusting apparatus for internal combustion engine according to the third aspect of the present invention is constructed such that the bias means urges the camshaft of an intake-valve system for opening and closing the intake valve toward the retard side, and the urging force is set to the level equal to or below the average inertia torque of the camshaft within the period until the spark ignition occurs after one rotation of the crank shaft at the starting time of the combustion engine.

The valve timing adjusting apparatus for internal combustion engine according to further aspect of the present invention is constructed such that the bias means is formed by a spring having a returning force such as a spiral spring and a coil spring disposed between the rotor and the casing.

The valve timing adjusting apparatus for internal combustion engine according to further aspect of the present invention is constructed such that the bias means is disposed at one side of the rotor, which is opposite to the direction in which the camshaft is extended, and supplies an urging force to the rotor and the casing.

BRIEF DESCRIPTION OF THE DRAWINGS

FIGS. 6A and 6B are graphs each showing the phase difference between the timing pulley and the rotor, wherein FIG. 6A shows the variation of the phase difference therebetween when no urging force is supplied to the rotor, whereas FIG. 6B shows the variation of the phase difference therebetween when an urging force equivalent to the average torque Tc is applied.

DETAILED DESCRIPTION OF THE PREFERRED EMBODIMENTS

Several embodiments of the present invention are now explained as in the followings.

First Embodiment

Figure 1:
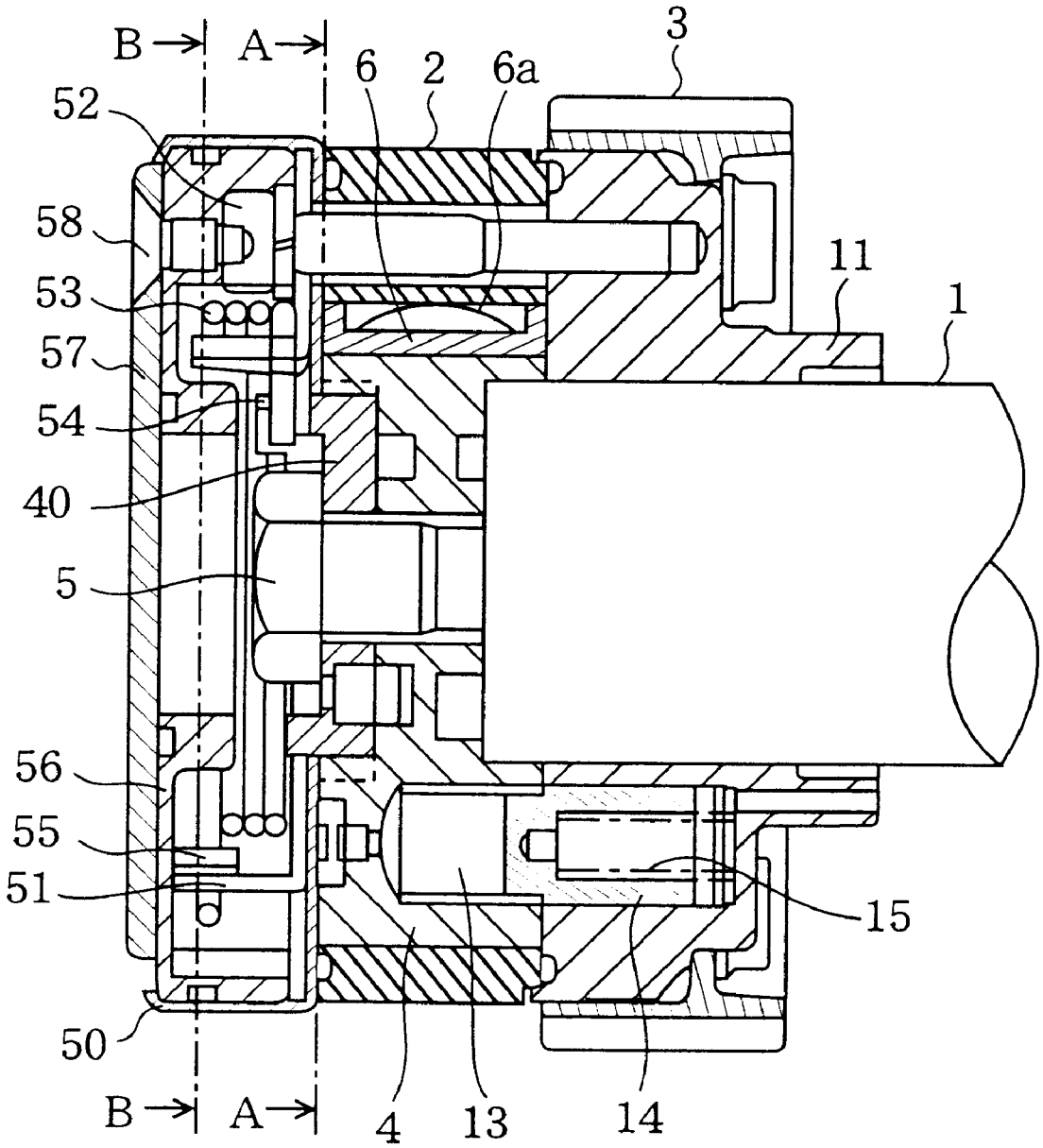
FIG. 1 is a schematically illustrated axial sectional view showing an important portion of a valve timing adjusting apparatus for internal combustion engine according to a first embodiment of the present invention.
Figure 2:
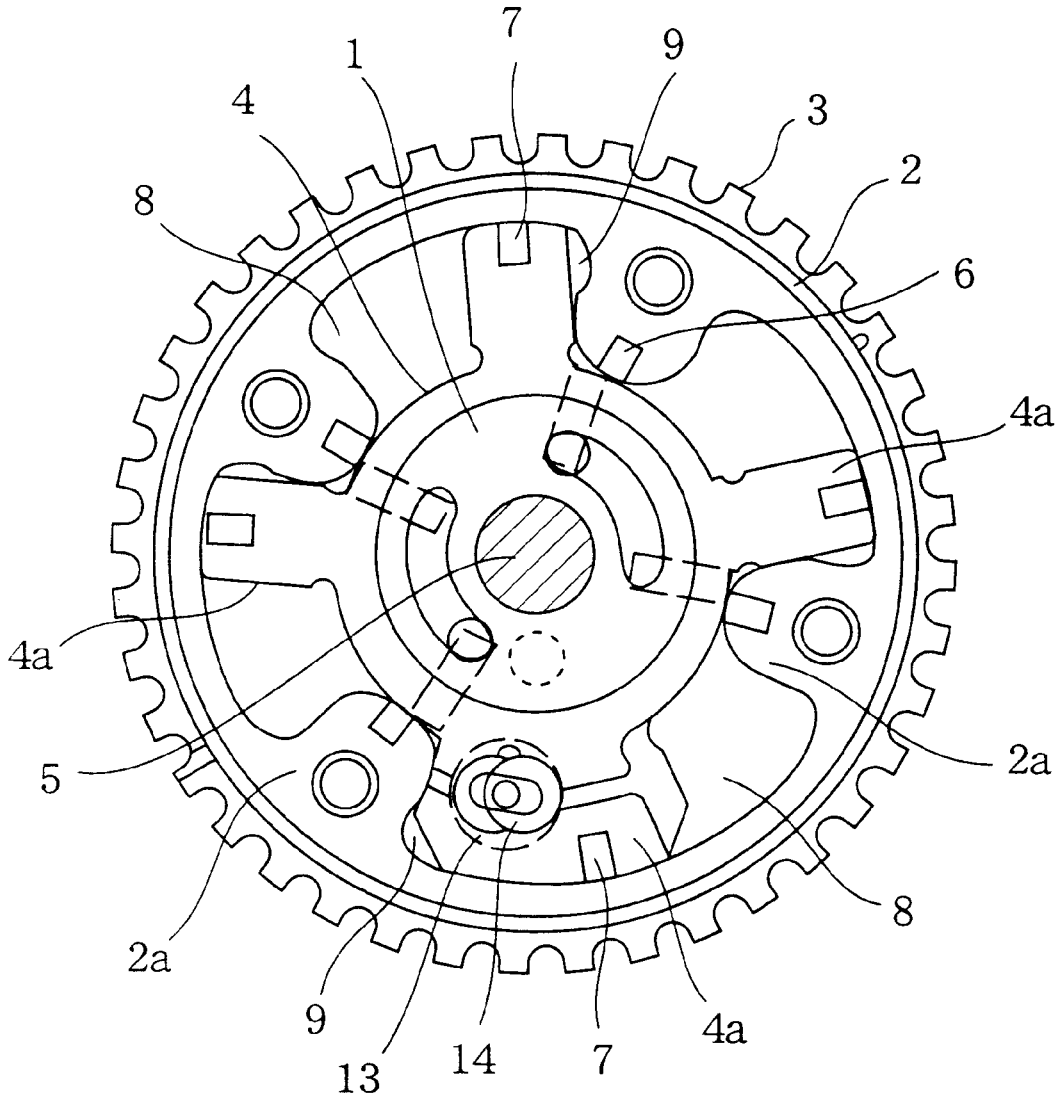
FIG. 2 is a diametrical sectional view observed along the line A—A of FIG. 1.
Figure 3:
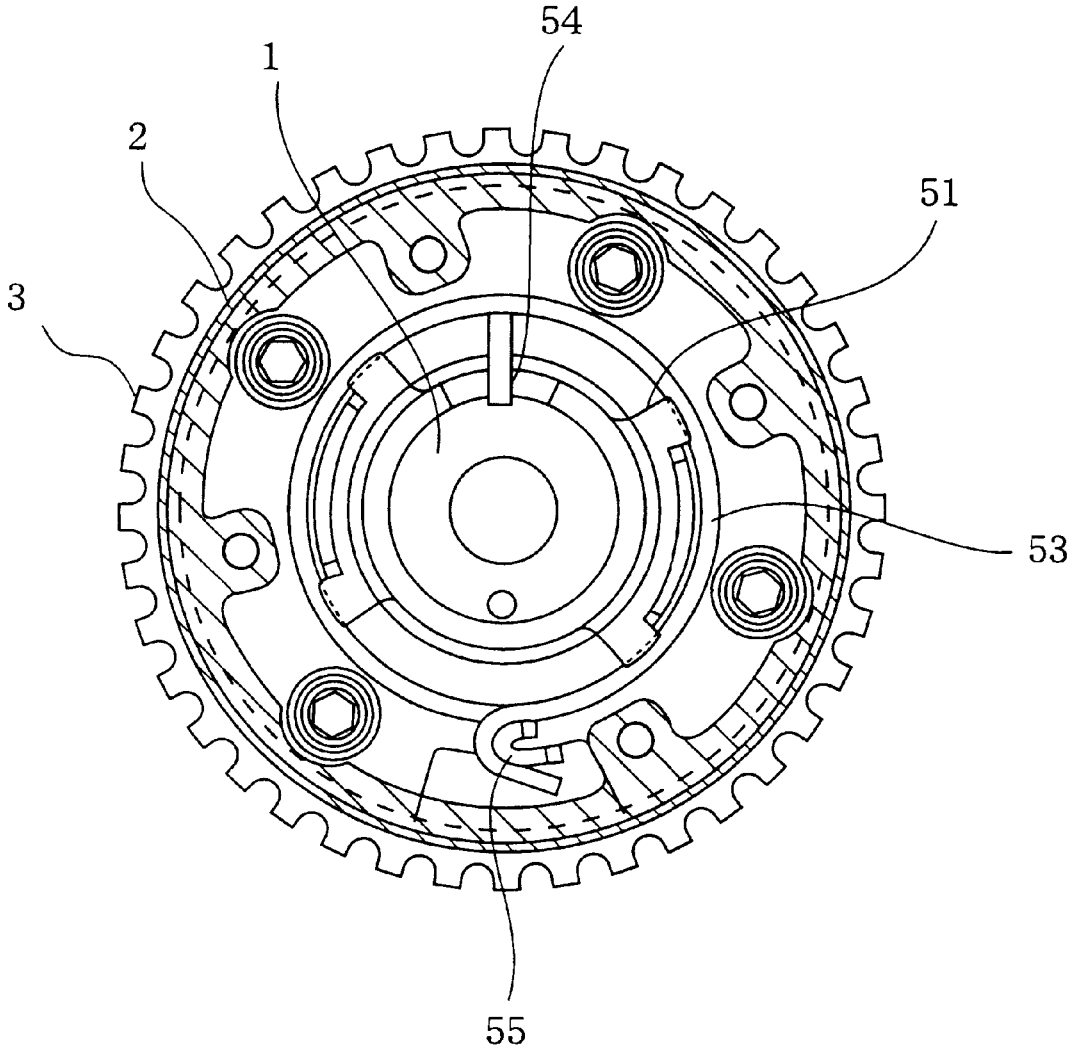
FIG. 3 is a diametrical sectional view observed along the line B—B of FIG. 1.

FIG. 1 is a schematically illustrated axial sectional view showing an important portion of a valve timing adjusting apparatus for internal combustion engine according to a first embodiment of the present invention. FIG. 2 is a diametrical sectional view observed along the line A—A of FIG. 1, whereas FIG. 3 is a diametrical sectional view observed along the line B—B. In FIGS. 1 and 3, reference numeral 1 denotes a camshaft residing in the system for opening and/or closing the intake and/or exhaust valve of the internal combustion engine, numeral 11 denotes a housing member which is rotatably fitted around the external surface of one end of the camshaft 1, 3 denotes a timing pulley fitted around the external surface of the housing member 11, and 2 denotes a casing that is coupled to a side surface of the housing member 11, wherein the timing pulley 3, the housing member 11 and the casing 2 are coaxially rotated when the timing pulley 3 receives a rotational force from a crank shaft of the internal combustion engine.

Further, reference numeral 4 denotes a rotor accommodated in the casing 2 in a rotatable manner within a predetermined range. Since this rotor 4 is firmly coupled to one axial end of the camshaft 1 with an axial bolt 5 by way of a washer 40 having a U-shaped sectional surface, the rotor 4 and the washer 40 are coaxially rotated, and the casing 2 and the rotor 4 can be relatively rotated to each other. It is to be noted that the washer 40 is constructed in such a manner that the open end of the U-shaped sectional surface thereof is projected from the axial end surface of the rotor 4 in the axial direction which is opposite to the direction in which the camshaft 1 is extending (hereinafter may be referred to just as "counter-camshaft side of the rotor 4"), and this projecting portion is referred to as an "end projection of the washer 40".

Reference numeral 50 denotes a spring case which is ratably fitted around the external surface of the end projection of the washer 40, numeral 51 denotes a spring holder which is accommodated within the spring case 50, and these spring case 50 and the spring holder 51 are firmly coupled to the casing 2 with a bolt 52. In this way, the spring case 50 coupled to the casing 2 together with the spring holder 51 configures a wall surface of the counter-camshaft side of an advancing hydraulic chamber 8 and a retarding hydraulic chamber 9.

Reference numeral 53 denotes a coil spring as a bias means that generates an urging force between the casing 2 and the rotor 4. This coil spring 53 is set to the level which is equivalent to or below the average inertia torque of the camshaft 1 at the time of starting of the combustion engine within the period until a first spark ignition occurs after one rotation of the crank shaft 1, and the urging force thereof is supplied to the rotor 4, wherein the coil spring 53 is disposed at the counter-camshaft side of the rotor 4 and retained by the spring holder 51.

Reference numeral 54 denotes a first hook portion for hooking one end of the coil spring 53 to the rotor 4 side, and this first hook portion 54 is formed by a hooking groove provided, for example, in the end projection of the washer 40 which is coaxially rotated with the rotor 4. Numeral 55 denotes a second hook portion for hooking the other end portion of the coil spring 53 to the casing 2 side, and this second hook portion is formed of a hooking projection provided for example on the spring holder 51. Reference numeral 56 denotes a covering member fitted into the spring case 50, and numeral 57 denotes a blind cap firmly fixed to the covering member 56 with a screw 58, wherein these covering member 56 and blind cap 57 are provided for preventing an external oil leakage.

In FIG. 2, reference numeral 2*a* denotes a plurality of shoes protrudedly formed on the inner peripheral surface of the casing 2 at same intervals, numeral 6 denotes a first chip seal provided to the end portion of each of the shoes 2*a*, and this chip seal is urged toward the center of rotation of the casing 2 by a back spring 6*a* shown in FIG. 1, and the end portion of each of the shoes 2*a* is slidablly contacted to the rotational body of the rotor 4. Numeral 4*a* denotes a plurality of vanes each protrudedly formed on the external peripheral surface of the rotor 4 and extended in the radial direction, numeral 7 denotes a second chip seal which is provided on the end portion of each of the vanes 4*a*, and by way of this second chip seal, the end portion of each of the vanes 4*a* is slidably contacted to the inner peripheral surface of the casing 2. It is to be noted that the chip seal 7 provided to the end portion of each of the vanes 4*a* is also urged toward the inner peripheral surface of the casing 2 by an urging force of the back spring, just as the case of the chip seal 6 provided on the end portion of each of the shoes 2*a*.

Reference numeral 8 denotes a plurality of advancing hydraulic chambers, each leading the oil pressure for rotating the rotor 4 toward the advance side, numeral 9 denotes a plurality of retarding hydraulic chambers each leading the oil pressure for rotating the rotor 4 toward the retard side. Each of these advancing hydraulic chambers 8 and each of the retarding hydraulic chambers 9 are formed between each of the shoes 2*a* and the corresponding one of the vanes 4*a*, which are provided further between the casing 2 and the rotor 4.

In FIGS. 1 and 2, numeral 13 denotes a locking hole formed in one of the vanes 4*a* of the rotor 4, and oil is fed to the locking hole 13 from an oil pressure providing system. Numeral 14 denotes a locking pin provided to the housing member 11 in an axially slidable manner which coaxially rotates with the casing 2, wherein this locking pin 14 is provided to be fitted into or retreated from the locking hole 13, and is urged toward the fitting direction by the spring 15. Therefore, oil pressure is applied to the direction reverse to the urging direction of the spring 15, wherein when the oil pressure is below the level of the urging force of the spring 15, the locking pin 14 is fitted into the locking hole by the urging force of the spring 15, and thus, the casing 2 and the rotor 4 are interlocked in a coaxially rotatable manner. In this locked state, when the oil pressure applied to the locking pin 14 overcomes the urging force of the spring 15, the locking pin is retreated from the locking hole 13 against the urging force of the spring 15, so that the casing 2 and the rotor 4 are released from the locked state, and because of their relative rotations, the opening and/or closing timing of the valve can be controlled.

Figure 4:
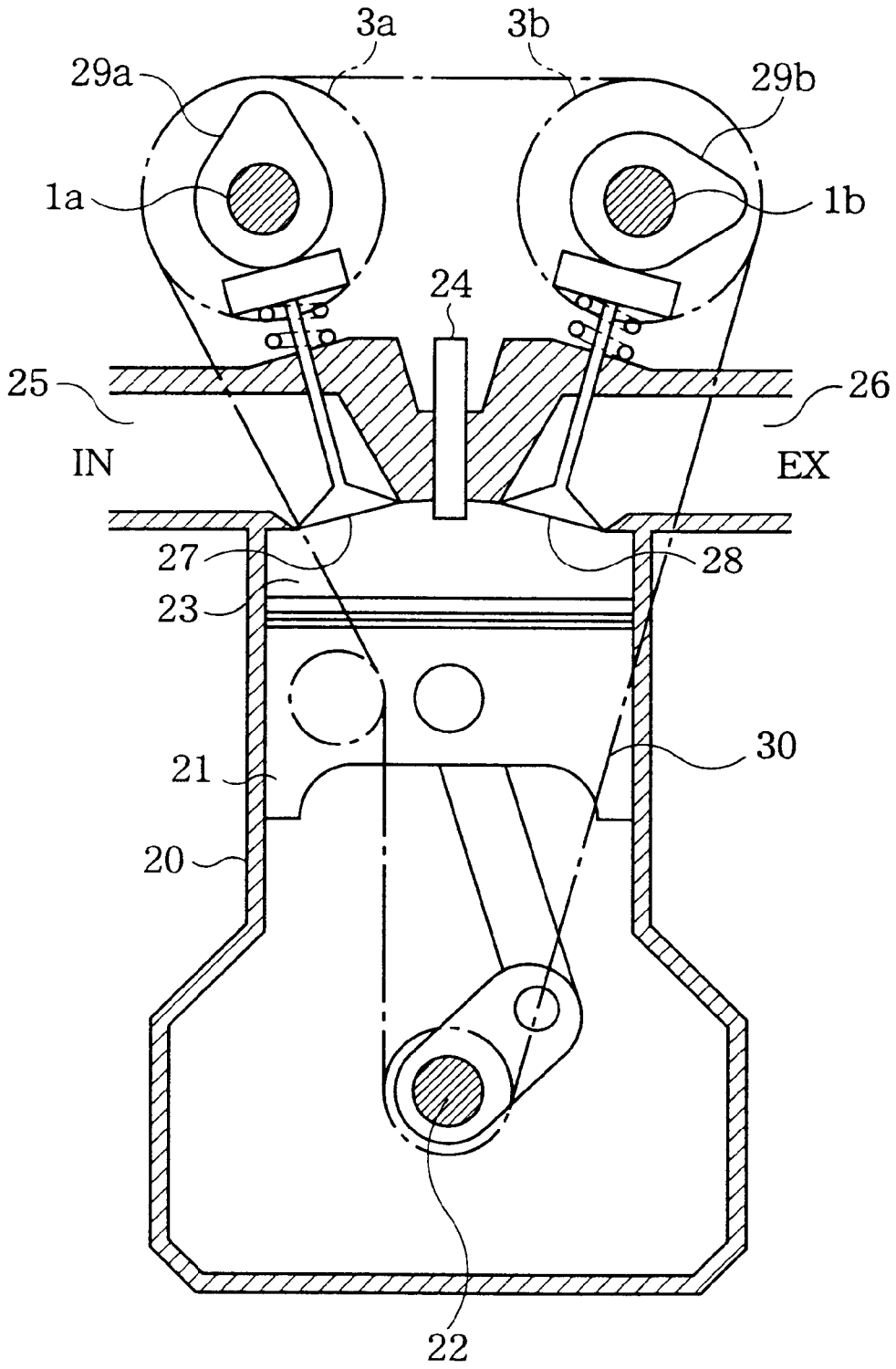
FIG. 4 is a general sectional view showing one example of the combustion engine equipped with the valve timing adjusting apparatus for internal combustion engine according to the first embodiment of the present invention.

FIG. 4 is a general sectional view showing one example of the internal combustion engine which is provided with the valve timing adjusting apparatus for combustion engine according to the first embodiment of the present invention.

In the figure, reference numeral 20 denotes a cylinder of the combustion engine, numeral 21 denotes a piston that reciprocally moves within the cylinder 20, 22 denotes a crank shaft which is driven to rotate by the reciprocal movement of the piston 21, 23 denotes a combustion chamber for igniting and exploding the mixed fuel gas, 24 denotes a ignition plug for conducting a spark ignition to the compressed mixed fuel gas in the combustion chamber 23, 25 denotes an inlet passage for supplying the mixed fuel gas to the combustion chamber 23, 26 denotes an outlet passage for exhausting the combustion gas from the combustion chamber, 27 denotes an intake valve for opening and/or closing the inlet passage 25, 28 denotes an exhaust valve for opening and/or closing the outlet passage 26, 1*a* denotes an intake-side camshaft, which contains a cam 29*a* that drives the intake valve 27 to open and/or close, 1*b* denotes an outlet-side camshaft, which contains a cam 29*b* that drives the exhaust valve 28 to open and/or close, 3*a* denotes an intake-side timing pulley (timing sprocket) coaxially provided on the intake-side camshaft 1*a*, 3*b* denotes a timing pulley (or timing sprocket) coaxially provided on the exhaust-side camshaft 1*b*, 30 denotes a timing belt (or timing chain) that connects the intake-side timing pulley 3*a* and the exhaust-side timing pulley 3*b* to the crank shaft 22. It is to be noted here that the intake-side camshaft 1*a* and the exhaust-side camshaft 1*b* correspond to the camshaft 1 in FIG. 1, whereas the intake-side timing pulley 3*a* and the exhaust-side timing pulley 3*b* correspond to the timing pulley 3 in FIG. 1.

The operation of the valve timing adjusting apparatus for internal combustion engine according to the first embodiment is now explained below.

The rotational force of the crankshaft 22 during the driving state of the internal combustion engine is transmitted to both the intake-side and exhaust-side timing pulleys 3*a* and 3*b* by way of the timing belt 30. On this occasion, when the casing 2 and the rotor 4 shown in FIG. 1 are interlocked by the locking pin 14, the casing 2, the rotor 4, and the intake-side and exhaust-side camshafts 1*a* and 1*b* (shown as camshaft 1 in FIG. 1) are coaxially rotated, and the intake valve 27 and the exhaust valve 28 are thereby driven to open and/or close at the respective timings, respectively by the cam 29*a* of the intake-side camshaft 1*a* and the cam 29*b* of the exhaust-side camshaft 1*b*. In this state, oil pressure that varies in accordance with the driving state of the internal combustion engine is provided from the oil pressure control system to each of the advancing hydraulic chambers 8 and the retarding hydraulic chambers 9, as well as to the locking hole 13, and when the oil pressure overcomes the urging force of the spring 15 urging the locking pin 14 toward the locking hole 13, the locking pin 14 is retreated from the locking hole 13, thereby to release the casing 2 and the rotor 4, and thereafter by the relative rotations of the casing 2 and the rotor 4, the intake valve 27 and the exhaust valve 28 are optimally controlled in accordance with the driving state of the internal combustion engine.

Here, an explanation is given below concerning the relationship among the maximum inertia torque and the average inertia torque at the starting time of the internal combustion engine, and the average torque within the period until the first spark ignition occurs.

Figure 5:
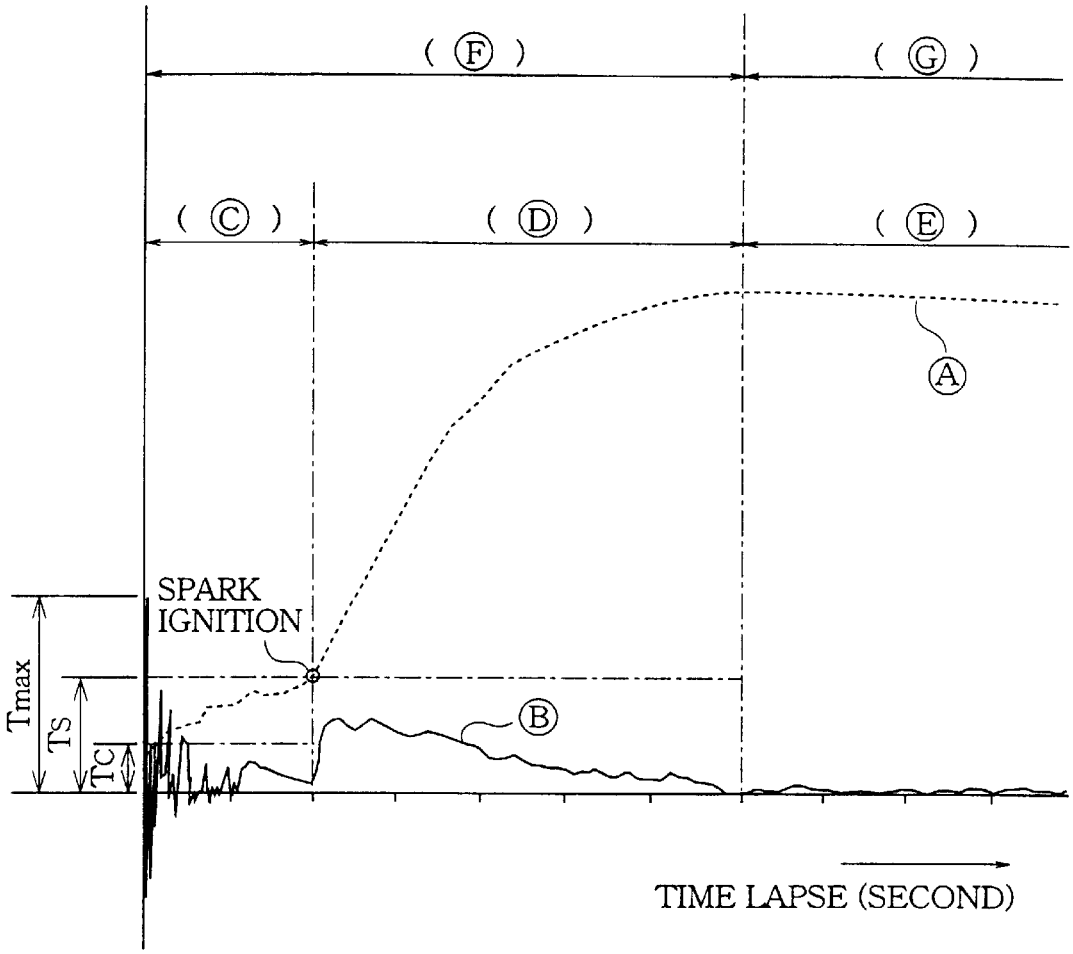
FIG. 5 is a characteristic graph showing the time-lapse variation of the inertia torque of the camshaft.

FIG. 5 is a characteristic graph showing the time-lapse variation of the inertia torque of the camshaft 1 during the period from the inactive state of the internal combustion engine until the timing immediately after the starting of the internal combustion engine. In the figure, the dashed line Ⓐ represents the number of rotation of the cam shaft 1, the solid line Ⓑ represents the average inertia torque of the cam shaft 1, and further, the axis of abscissa represents the lapse of time, during which the ignition plug 24 is ignited after a time lapse of Ⓒ corresponding to one rotation of the crank shaft 22, the rotation number is raised due to the explosion of fuel during the time period indicated by Ⓓ, and thereafter the combustion engine is stably rotated at a Predetermined number of rotations.

By the way, the range represented by the time periods Ⓒ+Ⓓ, in which the number of rotation of the camshaft 1 is gradually increased and the internal combustion engine reaches a fully exploding state Ⓔ, is referred to as the starting state Ⓕ of the combustion engine, whereas the range in which the engine is in the fully exploding state is referred to as the idling state Ⓖ.

In this case above, the maximum inertia torque and the average inertia torque at the time of starting of the combustion engine are represented, respectively by Tmax and Ts in the figure.

Further, the average inertia torque within the period until the timing of the first spark ignition is represented by Tc, and the relation of these three torques will be, as obviously shown in the figure, such that the average inertia torque Tc within the period until the timing of the first spark ignition is the smallest, wherein the relation of these three elements as a whole is Tmax>Ts>Tc.

Figure 6A:
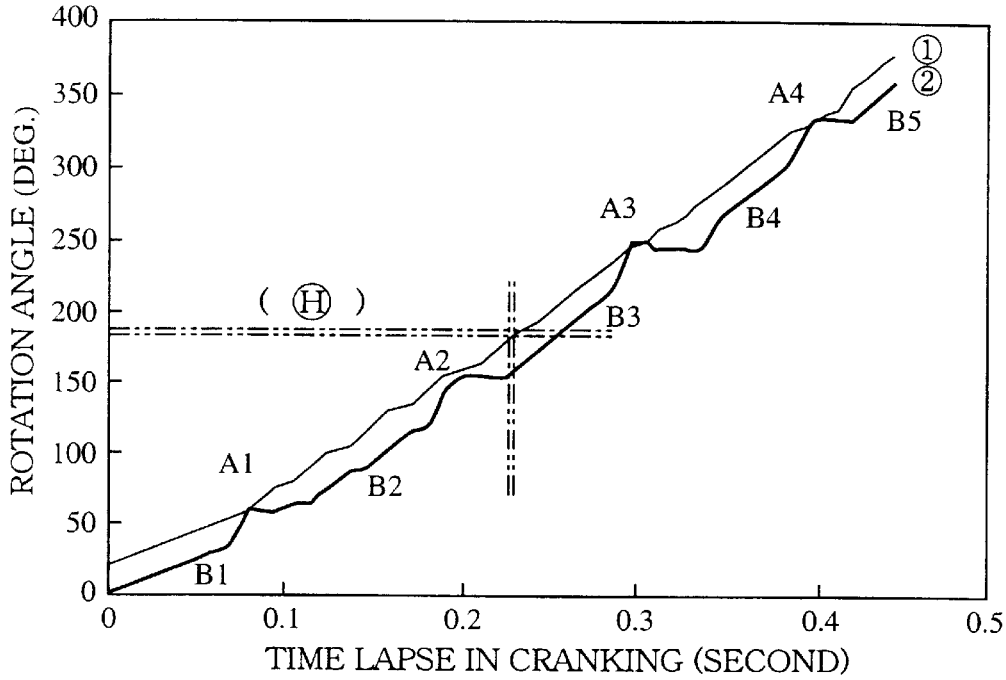
Figure 6B:
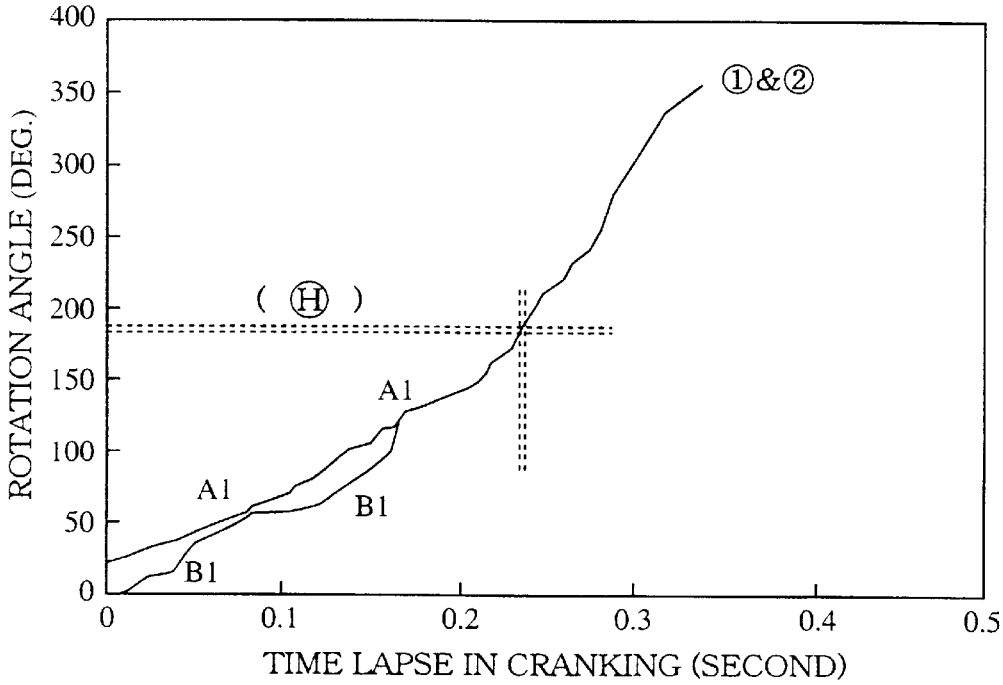

FIGS. 6A and 6B are graphs each showing the phase difference between the timing pulley 3 and the rotor 5 as a result of the experiments respectively when an urging force is applied to the rotor 4 at the starting time of the internal combustion engine, and when not. In these figures, FIG. 6A shows a variation of the phase of the timing pulley 3 and that of the rotor 5 in the state that no urging force is applied, whereas FIG. 6B shows a variation of the phase of the timing pulley 3 and the rotor 5 in the state that an urging force equivalent to the average torque Tc is applied. It is to be noted that FIG. 6B shows the variations of the phases in the cast that the valve timing adjusting apparatus according to the first embodiment of the present invention is applied to the exhaust-side camshaft 1*b* of FIG. 4.

In FIGS. 6A and 6B, the line ① represents the rotation angle the casing 2, whereas the line ② represents the rotation angle of the rotor 4. Further, each of the points A1 to A4 indicates the state in which the rotor 4 and the casing 2 have been brought into contact with each other in the advance direction, whereas each of the points points B1 to B4 indicates the state in which they are separate from each other in the retard direction.

By the way, in the state in which no urging force is applied as shown in FIG. 6A, the casing 2 and the rotor 4 are alternatively repeating in and out of contact with each other even after the time period Ⓗ corresponding to one rotation of the crank shaft 22 has passed, and as a result, the internal combustion engine has been brought into a state that its starting operation is made impossible. It goes without saying that it is caused by the varied torque of the camshaft 1.

Contrary to this, when an urging force equivalent: to the average torque Tc shown in FIG. 6B is applied to the rotor 4 in the advance direction, since the casing 2 and the rotor 4 are brought into full contact with each other in the advance direction after the period Ⓗ corresponding to one rotation of the crank shaft 22, the internal combustion engine was enabled to start properly.

According to the first embodiment as explained hereinabove, since it is arranged such that the urging force of the coil spring 53 that urges the rotor 4 to the casing 2 in the advance direction is set to the level equal to or below the average inertia torque of the camshaft 1 within the time period until the first spark ignition occurs at the starting time of the internal combustion engine, even if the combustion engine comes to a halt in the state that the advanced position holding mechanism of the valve timing adjusting apparatus is inactive, the rotor 4 can be shifted toward the advance side with respect to the casing 2 by the varied torque of the camshaft 1 at the starting time of the combustion engine and also the urging force of the spring coil 53 applied to the rotor 4, and thus the advanced position holding mechanism can be configured as operating at the most advanced position, so that the rotor 4 can be maintained at the most advanced position by the operation of the advanced position holding mechanism.

As explained above, since it is arranged such that in the state where the rotor 4 is maintained at the most advanced position, the overlapped level of the timing to open the intake valve 27 and the timing to close the exhaust valve 28 is made optimum, the returning of the combustion gas stored in the combustion chamber 23 to the inlet passage 25 can be reduced, and the combustion engine can thereby be started properly.

Further, according to the first embodiment explained above, the oil pressure, which is supplied from the oil pressure control system to the advancing hydraulic chamber 8 and the retarding hydraulic chamber 9 after the combustion engine has been started, varies in accordance with the driving state of the combustion engine, and the relative rotation phase difference between the casing 2 and the rotor 4 is adjusted in accordance with the variation of the oil pressure, so that if the relative rotation phase difference between the camshaft 1 and the crank shaft 22, which corresponds to the relative rotation phase difference between the casing 2 and the rotor 4, is adjusted, the timing for opening and/or closing the exhaust valve 28 by the exhaust-side cam 29*b* can be set to an optimum level that matches the driving state of the combustion engine.

Furthermore, since the urging force of the coil spring 53, which urges the rotor of the system for opening and/or closing the exhaust valve 28 toward the advance side is set to the level equal to or below the average inertia torque of the camshaft 1 within the time period until the spark ignition occurs after one rotation of the crank shaft 22 at the starting time of the combustion engine, shifting the rotor 4 toward the retard side is enabled with a relatively small force, thereby improving the response characteristic thereof.

Still further, according to the first embodiment above, since the coil spring 52 and the related configuring members such as the spring case 50 and the spring holder 51 are separated from the casing 2 and the rotor 4, for example in the case of a combustion engine, in which the valve timing adjusting apparatus is provided to both the intake-side camshaft 1*a* and the exhaust-side camshaft 1*b* of FIG. 4, the essential elements of the valve timing adjusting apparatus such as a casing, a rotor, a housing, timing pulleys (or timing sprockets) and so on can be shared, and due to this, the total cost as a whole can be reduced.

All this above is regarding the case in which the valve timing adjusting apparatus according to the present embodiment is applied to the exhaust-side camshaft 1*b* (FIG. 4) of the combustion engine. However, even in a case that the valve timing adjusting apparatus is provided to the intake-side camshaft 1*a*, it suffices if the rotor 4 of the intake-side camshaft 1*a* is urged toward the retard side by the coil spring 53, and the urging force is set to the level equal to or below the average inertia torque of the camshaft 1 within the period until crank shaft comes to the spark ignition timing at the starting time of the combustion engine, so that the same effect as above can be obtained.

Second Embodiment

Figure 7:
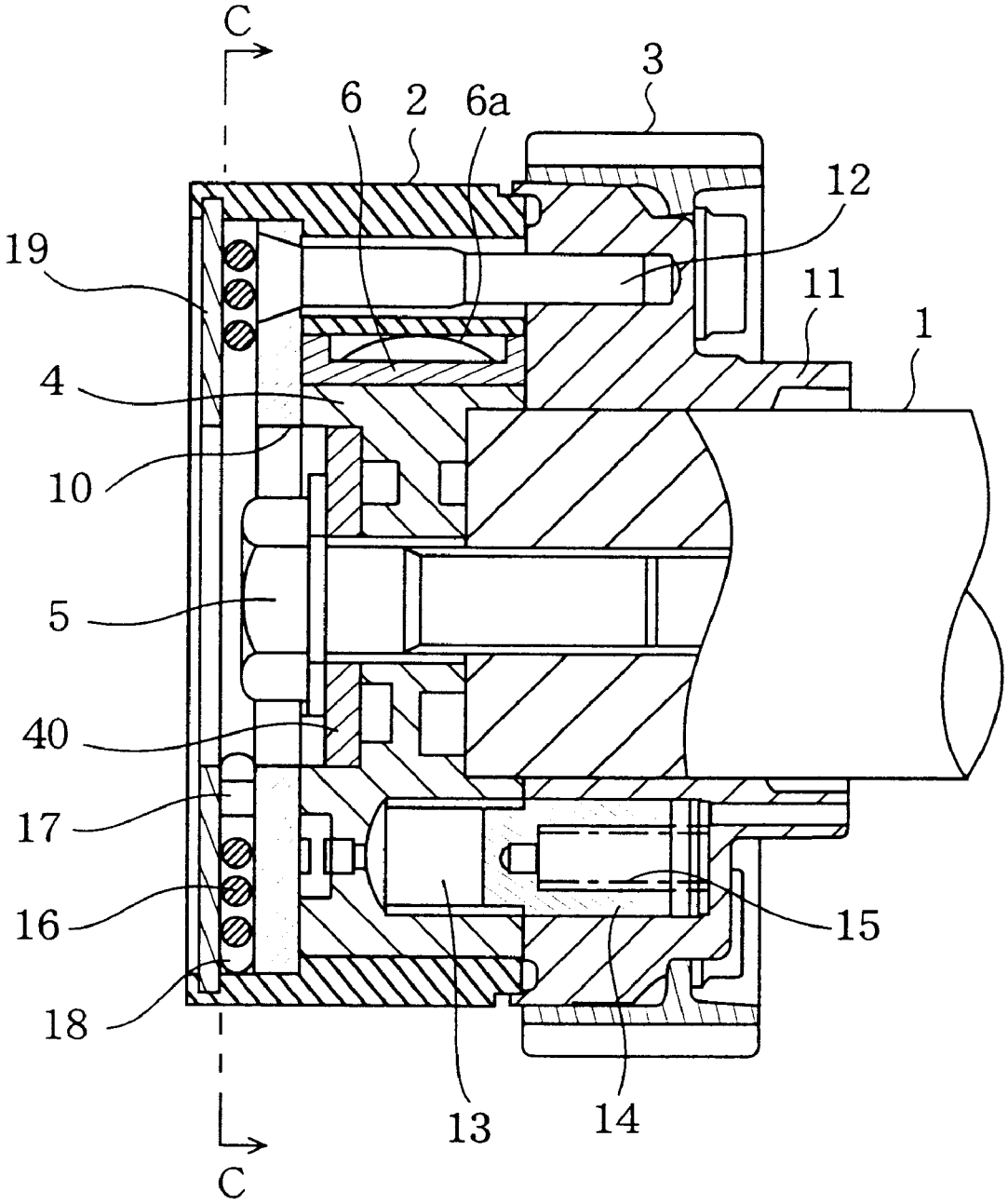
FIG. 7 is a schematically illustrated axial sectional view showing an important portion of a valve timing adjusting apparatus for internal combustion engine according to a second embodiment of the present invention.
Figure 8:
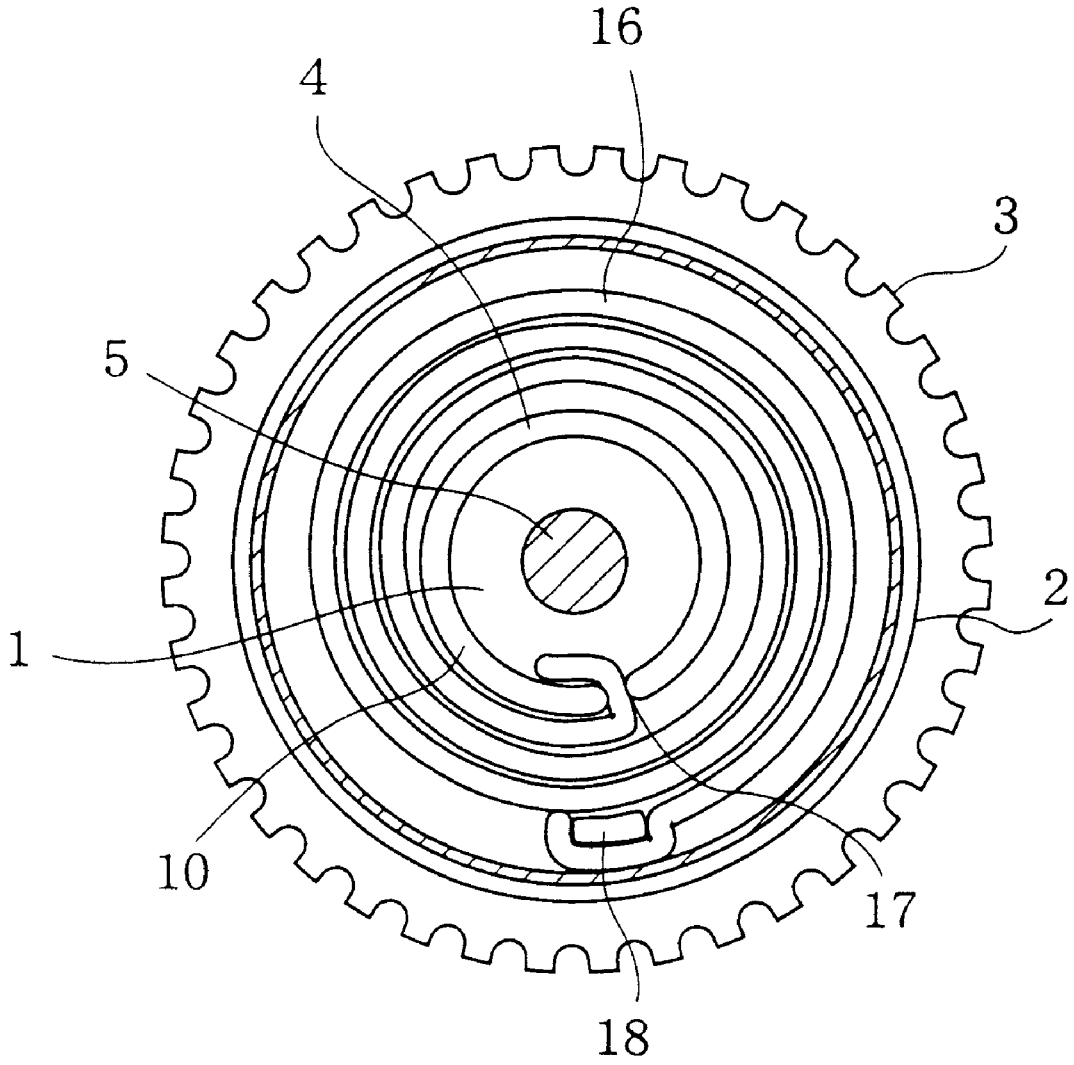
FIG. 8 is a diametrical sectional view observed along the line C—C.

FIG. 7 is a schematically illustrated axial sectional view showing an important portion of a valve timing adjusting apparatus for internal combustion engine according to a second embodiment of the present invention. FIG. 8 is a diametrical sectional view observed along the line C—C of FIG. 7, wherein same or similar members as or to those in FIGS. 1 to 4 are put the same reference numerals for omitting a repetition of the same explanation. In FIG. 7, reference numeral 10 denotes an annular plate connected to one axial end surface of the rotor 4, numeral 12 denotes a bolt that integrally fixes the plate 10, the casing 2 and the housing member 11, 16 denotes a spiral spring as a bias means for generating an urging force between the casing 2 and the rotor 4, which is, just as the coil spring 53 according to the first embodiment, set to such a level equal to or below the average inertia torque of the camshaft 1 within the time period until the crank shaft comes to the spark ignition timing at the time of starting of the combustion engine, wherein the urging force thus generated is supplied to the rotor 4, and this spiral spring 16 is disposed at the counter-camshaft side of the rotor 4. Reference numeral 17 denotes a first hook portion of the rotor 4 side, which is hooked to the inner diametrical end of the spiral spring 16, and is formed of a protruded portion provided on the plate 10 that coaxially rotates with the rotor 4, reference numeral 18 denotes a second hook portion of the casing 2 side, which is hooked to the external diametrical end of the spiral spring 16, and is, for example, of a notched groove formed in the casing 2, and numeral 19 denotes a spring cover fitted into the casing 2.

As explained hereinabove, since according to the second embodiment it is arranged such that the urging force which is generated by the spiral spring 16 and applied with respect to the rotor 4 is set, just like the case of the coil spring 53 of the first embodiment, to the level equal to or below the average inertia torque of the camshaft 1 within the time period until the first spark ignition occurs after one rotation of the crank shaft at the time of starting of the internal combustion engine, even if the combustion engine comes to a halt in the state that the advanced position holding mechanism of the valve timing adjusting apparatus is inactive, the rotor 4 can be shifted toward the advance side with respect to the casing 2 by the varied torque of the camshaft 1 at the time of starting of the combustion engine and the urging force of the spiral spring 16 applied to the rotor 4, and thus the advanced position holding mechanism can operate at the most advanced position, so that the rotor 4 can be maintained at the most advanced position by the operation of the advanced position holding mechanism.

As explained above, since it is arranged such that in the state in which the rotor 4 is maintained at the most advanced position, the overlapped level of the timing to open the intake valve 27 and the timing to close the exhaust valve 28 is made optimum, the returning of the combustion gas stored in the combustion chamber 23 to the inlet passage 25 can be reduced, and the combustion engine can thereby be started properly.

In addition, as it utilizes the spiral spring, the axial length can be reduced compared with the coil spring, the valve timing adjusting apparatus as a whole can be shortened in the axial direction thereof.

Further, according to the second embodiment explained above, the oil pressure, which is supplied from the oil pressure control system to the advancing hydraulic chamber 8 and the retarding hydraulic chamber 9 at the timing after the combustion engine has been started, varies in accordance with the driving state of the combustion engine, and the relative rotation phase difference between the casing 2 and the rotor 4 is adjusted in accordance with the variation of the oil pressure, so that if the relative rotation phase difference between the camshaft 1 and the crank shaft 22, which corresponds to the relative rotation phase difference between the casing 2 and the rotor 4, the timing for opening and/or closing the exhaust valve 28 by the exhaust-side cam **29*b*** can be set to the optimum level that matches the driving state of the combustion engine.

Furthermore, since the urging force of the spiral spring 53, which urges the rotor of the system for opening and/or closing the exhaust valve 28 toward the advance side, is set to the level equal to or below the average inertia torque of the camshaft 1 within the period until the spark ignition occurs after one rotation of the crank shaft 22 at the starting time of the combustion engine, shifting the rotor 4 toward the retard side is enabled with a relatively small force, improving thereby the response characteristic thereof.

The coil spring 53 and the spiral spring 16 are applied as the bias means respectively in the first and the second embodiments. However, the bias means to be applied to the present invention includes all kinds of springs, if the returning force thereof can be used as an urging force.

Further, in the first embodiment explained above, if the valve timing adjusting apparatus is of the type which is installed within the combustion engine and permitting thus an external oil leakage, the cover 56 and the blind cap 57 can both be obviated.

Still further, in both the first and second embodiments explained above, the timing pulley 3 can be replaced by a timing sprocket, and the timing pulley and the timing sprocket can be integrally molded, any of which cases can obtain the same effects.

As explained hereinabove, according to the present invention, since it is arranged such that an urging force generated by a bias means between the casing and the rotor is set to the level equal to or below the average inertia torque of the camshaft within the time period until the spark ignition occurs after one rotation of the crank shaft at the starting time of the combustion engine, shifting the rotor toward the advance side or retard side is enabled with a relatively small force, improving thereby the response characteristic of the valve opening/closing system.

Further, according to the present invention, since an urging force of the bias means that urges the camshaft of the exhaust valve system is set to the level equal to or below the average inertia torque of the camshaft 1 within the period until the first spark ignition at the starting time of the internal combustion engine, even if the combustion engine comes to a halt, the rotor can be shifted toward the advance side with a relatively small force, thereby improving the response characteristic of the exhaust-side valve opening/closing system.

Further, according to the present invention, since an urging force of the bias means that urges the camshaft of the exhaust valve system is set to the level equal to or below the average inertia torque of the camshaft 1 within the time period until the first spark ignition at the starting time of the internal combustion engine, even if the combustion engine comes to a halt, the rotor can be shifted toward the retard side with a relatively small force, thereby improving the response characteristic of the intake-side valve opening/closing system.

Still further, according to the present invention, since the bias means that generates an urging force between the rotor and the casing is formed by a spring having a returning force such as a coil spring and a spiral spring, any kind of spring can be applied as the bias means, if the returning force thereof can be used as an urging force.

Yet still further, according to the present invention, since it is arranged such that the bias means is disposed at one side of the rotor, which is opposite to the direction in which the camshaft is extended, most of the essential configuring members of the valve timing adjusting apparatus can be shared with the conventionally used ones, raising thereby the productivity thereof, yet reducing the total cost.

What is claimed is:

1. A valve timing adjusting apparatus for internal combustion engine comprising:

a camshaft for opening and closing at least one of an intake valve and an exhaust valve in an internal combustion engine, a casing which is rotatably mounted around said camshaft, and rotates in accordance with the movement of a crank shaft of the internal combustion engine, a rotor which is connected to said camshaft and accommodated in said casing, and is capable of rotating coaxially with and relatively to said casing, and a bias means for generating an urging force between said rotor and said casing, wherein said valve timing adjusting apparatus is arranged in such a manner that the urging force is set to the level equal to or below the average inertia torque of said camshaft within the period until the spark ignition occurs after one rotation of the crank shaft at the starting time of the combustion engine.

2. A valve timing adjusting apparatus for internal combustion engine according to claim 1, wherein said bias means is formed by a spring having a returning force and being disposed between said rotor and said casing.

3. A valve timing adjusting apparatus for internal combustion engine according to claim 1, wherein said bias means is disposed at one side of said rotor, which is opposite to the direction in which said camshaft is extended, and supplies said urging force to said rotor and said casing.

4. A valve timing adjusting apparatus for internal combustion engine according to claim 1, wherein said bias means urges the camshaft of an exhaust-valve system for opening and closing said exhaust valve toward an advance side.

5. A valve timing adjusting apparatus for internal combustion engine according to claim 4, wherein said bias means is formed by a spring having a returning force and being disposed between said rotor and said casing.

6. A valve timing adjusting apparatus for internal combustion engine according to claim 4, wherein said bias means is disposed at one side of said rotor, which is opposite to the direction in which said camshaft is extended, and supplies said urging force to said rotor and said casing.

7. A valve timing adjusting apparatus for internal combustion engine according to claim 1, wherein said bias means urges said camshaft of an intake-valve system for opening and closing said intake valve toward a retard side.

8. A valve timing adjusting apparatus for internal combustion engine according to claim 7, wherein said bias means is formed by a spring having a returning force and being disposed between said rotor and said casing.

9. A valve timing adjusting apparatus for internal combustion engine according to claim 7, wherein said bias means is disposed at one side of said rotor, which is opposite to the direction in which said camshaft is extended, and supplies said urging force to said rotor and said casing.

* * * * *